US008608144B2

(12) United States Patent
Thomas et al.

(10) Patent No.: US 8,608,144 B2
(45) Date of Patent: Dec. 17, 2013

(54) CABLE GRIPPERS

(75) Inventors: Andrew James Thomas, Hampshire (GB); Jeremy John Richard Featherstone, Essex (GB)

(73) Assignee: Ocean Cable Technologies Limited, Portsmouth, Hampshire (GB)

( * ) Notice: Subject to any disclaimer, the term of this patent is extended or adjusted under 35 U.S.C. 154(b) by 1120 days.

(21) Appl. No.: 11/995,951

(22) PCT Filed: Jan. 9, 2007

(86) PCT No.: PCT/GB2007/000040

§ 371 (c)(1),
(2), (4) Date: May 12, 2008

(87) PCT Pub. No.: WO2007/080384

PCT Pub. Date: Jul. 19, 2007

(65) Prior Publication Data

US 2008/0203639 A1 Aug. 28, 2008

(30) Foreign Application Priority Data

Jan. 11, 2006 (GB) ..... 0600445.1

(51) Int. Cl.
*B25B 1/24* (2006.01)

(52) U.S. Cl.
USPC ..... 269/257; 269/249; 269/54

(58) Field of Classification Search
USPC ..... 269/257, 902, 264, 249, 143, 95, 6, 3, 269/71, 54; 29/257, 276
See application file for complete search history.

(56) References Cited

U.S. PATENT DOCUMENTS

| | | | | | |
|---|---|---|---|---|---|
| 3,516,158 | A | | 6/1970 | Ferrentino | |
| 3,826,160 | A | * | 7/1974 | Allen et al. | 29/238 |
| 3,990,255 | A | | 11/1976 | Cosier et al. | |
| 4,282,783 | A | * | 8/1981 | Fortune | 81/427.5 |
| 4,363,475 | A | * | 12/1982 | McCarty | 269/69 |
| 4,483,059 | A | * | 11/1984 | Dearman | 29/272 |
| 4,805,547 | A | | 2/1989 | Matsuzaki et al. | |
| 5,135,209 | A | * | 8/1992 | Penny | 269/249 |
| 5,172,620 | A | * | 12/1992 | Faust | 83/13 |

(Continued)

FOREIGN PATENT DOCUMENTS

| | | |
|---|---|---|
| DE | 4312713 | 10/1994 |
| DE | 4405964 | 5/1995 |

(Continued)

OTHER PUBLICATIONS

Porcheray G, "Evolution of Insulation Piercing Connector Technology", XP001060182, Oct. 28, 2001, vol. 2 of 2, pp. 830-836.

(Continued)

*Primary Examiner* — Lee D Wilson
(74) *Attorney, Agent, or Firm* — Young & Thompson

(57) ABSTRACT

An assembly of a cable gripper and a cable that has an outer protective layer formed from plastically deformable material, over an inner tensile strength portion). The cable gripper includes at least one gripper member having a supported outer end and an active inner end penetrating the outer protective layer and gripping the inner tensile strength portion beneath the outer protective layer. The active inner end includes a material of sufficient hardness to penetrate the outer protective layer by movement of the gripper member through the outer layer from an inoperative to an operative position.

30 Claims, 7 Drawing Sheets

(56) References Cited

U.S. PATENT DOCUMENTS

| | | | | |
|---|---|---|---|---|
| 5,234,242 | A | 8/1993 | Mizuguchi | |
| 6,374,499 | B1 * | 4/2002 | Cochran | 30/233 |
| 6,619,158 | B2 * | 9/2003 | Bates et al. | 81/9.4 |
| 7,004,682 | B1 * | 2/2006 | Moody | 405/184.4 |
| 2004/0041136 | A1 | 3/2004 | Ames et al. | |
| 2008/0203639 | A1 * | 8/2008 | Thomas et al. | 269/257 |

FOREIGN PATENT DOCUMENTS

| | | |
|---|---|---|
| FR | 2739729 | 4/1997 |
| FR | 2749210 | 12/1997 |
| GB | 04651 | 0/1910 |
| GB | 08272 | 0/1906 |
| GB | 657 758 | 9/1951 |
| GB | 685 378 | 1/1953 |
| GB | 1164093 | 9/1969 |
| GB | 1492988 | 11/1977 |
| GB | 2208912 | 4/1989 |
| GB | 2 292 359 | 2/1996 |
| WO | 03096072 | 11/2003 |
| WO | 2005062429 | 7/2005 |

OTHER PUBLICATIONS

Shigeyuki Akiba et al. "Submarine Cable Network Systems", pp. 321-332.

"TA17 Cable Gripper", Perry Slingsby Systems LTD. TECHNIP.

* cited by examiner

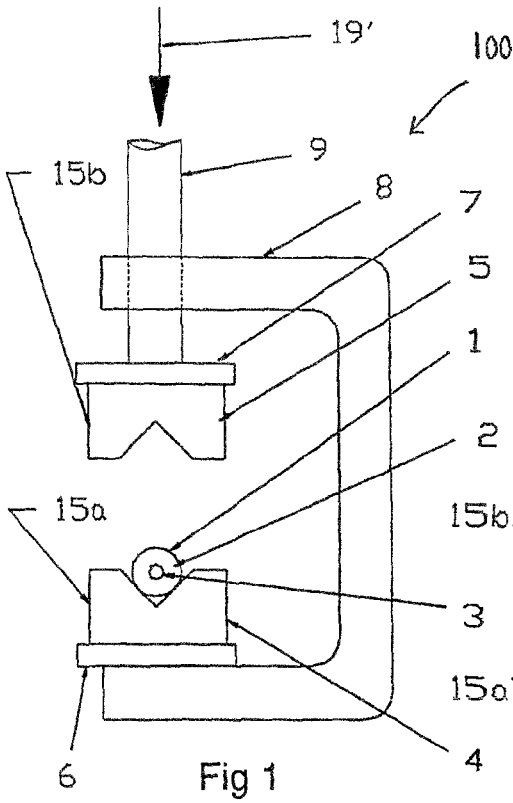
Fig 1
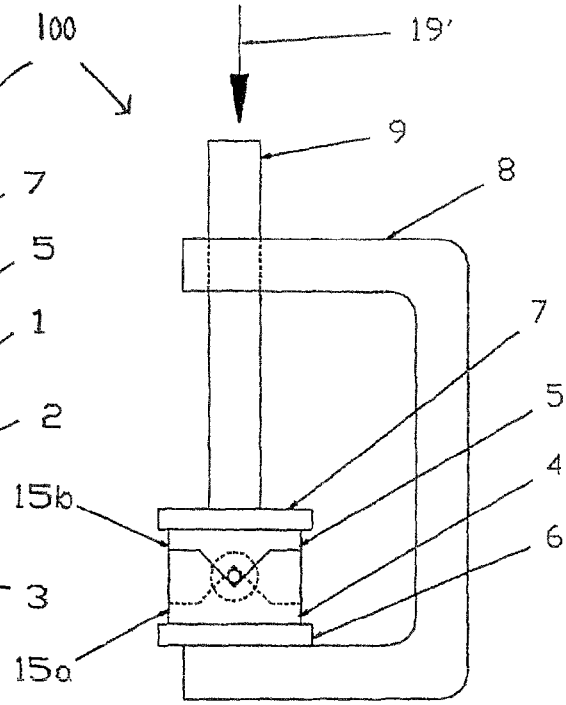
Fig 2
Fig 3
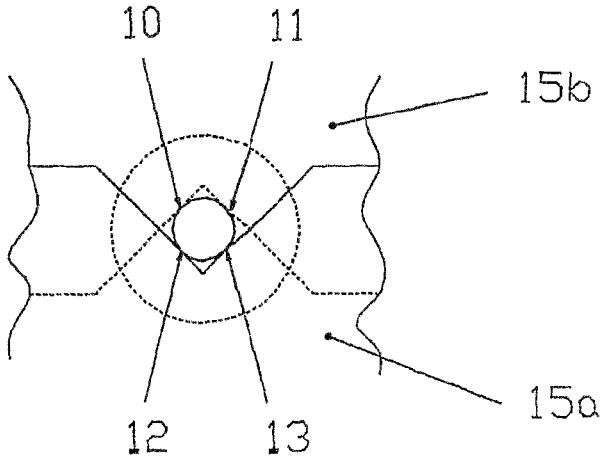

CABLE GRIPPERS

TECHNICAL FIELD

This invention relates to cable grippers. The term 'cable' throughout this specification should be taken to include any elongate structure having a transmission function. The present invention more particularly relates to grippers for cable having an inner tensile strength portion and an outer protective sheath portion of a second tensile strength, the second tensile strength being lower than the first. By "inner tensile strength portion" is meant throughout this specification, that portion of cable having a tensile strength function, i.e. which transmits tension and is able to withstand tension. Such tensile strength materials include drawn steel wires (with a typical tensile strength in the range 400 $N/mm^2$ to 2160 $N/mm^2$), steel pipe, or other metallic wires and pipes. Generally the inner tensile strength portion may be elongate.

The outer protective sheath material may be an extruded polymer, such as polyethylene, of relatively low tensile strength, typically 15 $N/mm^2$ to 40 $N/mm^2$. The outer layer of relatively lower tensile strength may include non-tensile function layers such as taping or conductive material, for example copper sheaths, and protective serving such as polypropylene yarn.

Grippers of this invention may be employed to grip any sheathed cable such as power cable, telecommunications cable, for example fibre optic cable, sheathed rope, sheathed pipe carrying fluid, or a control umbilical comprising a mixture of fluid lines or electrical or fibre optic control cables, and strength members.

BACKGROUND OF THE INVENTION

In order to pull or hold a cable under tension, a gripper device may be attached to the cable. There are many examples of this, for instance in pulling a cable through a duct, anchoring a cable end and lifting (or lowering) a cable end from ground level to a tower or from the seabed to a ship.

Lightweight submarine telecommunications cable has a fibre optic centre core typically surrounded by a rope of high tensile steel to provide axial strength, which in turn has a copper sheath, surrounded by a low tensile strength protective polyethylene outer sheath. In some examples of such cable (known as 'lightweight protected' or 'lightweight screened') an additional metallic barrier (typically an aluminium tape) and extruded outer polyethylene sheath is added to the basic lightweight cable construction to further protect the cable.

It has been found with one known gripper device that when the gripper device contacts the outer surface of such submarine telecommunications cable, there is a problem of insufficient friction between the cable layers being acted on by the gripper, and/or insufficient adhesion between the cable layers along the cable from the gripper to the free end of the cable, and consequently there is a tendency for the protective outer sheath to be stripped from the core with the result that the engaged end is lost. This is known as filleting as described in GBP 1,492,988. The gripping device in that disclosure transmits the tension necessary in the gripping operation to the cable strength portion by belaying a bight of cable about an axis.

However, it is not always possible or practicable to create a bight of cable, for instance if it is required to grip the cable very close to the end of the cable or if the tension in the cable is high and there is insufficient slack or energy available to create the bight, such as may occur on the seabed. In GBP 1,492,988 gripping is carried out using a complex arrangement including an hydraulic circuit which causes an axially mounted spool to rotate and belay the bight of cable by wrapping the cable on the spool and another hydraulic circuit to sever the cable by means of a separate clamp and blade, each movable against different shoulders on the gripper device.

An alternative known solution to grip cables with polymer sheaths, is to distribute the grip over a long length of the outer sheath by the use of a cable 'stopper', as described in GB 2,208,912A, hence utilising the available adhesion and friction between layers in the cable over a longer contact length. However, this is not always practicable, due to the long length of the stopper required and the manual intervention required in fitting. One case where this would not be practicable is where the gripper device needs to be remotely applied to the cable. One example of this is where the cable is under a high tension, such that it may be a risk to personnel to have to handle the cable to fit a stopper. Another example is in subsea applications, such as within a grapnel for recovering a cable end from the seabed, where both the length of a stopper, and the difficulty of remotely fitting it onto the cable without manual intervention, makes this approach impractical.

Undersea cables need to be recovered from the seabed to a ship for repair or reconfiguration, and this type of operation may need to be carried out in any water depth down to full ocean depth (up to 9000 m). In deep water the cable cannot be recovered to the ship without first cutting the cable. This is because the cable has generally been laid with insufficient slack to allow for the required increases in catenary lengths without exceeding the maximum tensile strength of the cable. Accessing deep sea cable is difficult in itself without the additional problems of remotely locating the cable, cutting and retaining the cable.

It is conventional practice to undertake a set of three grapnel drives, across the cable on the seabed. The first drive is to cut the cable, the second is to recover one end of the cable, and the third is to recover the remaining end of the cable. For the first drive, the grapnel is fitted with a blade capable of cutting the cable. For the second and third drives the grapnel is configured to capture the cable. The requirement for three separate operations is time-consuming, and the deeper the water, the longer the launch and recovery process for each operation takes. Additionally, each of the three operations has to locate the cable anew. If the grapnel passes over the cable, rather than capturing it, at least one additional attempt (a pass) will be required, and again the deeper the water, the longer this will take.

In recognition of this, several designs of grapnel have been developed in the past which combine cutting and holding functions, in which both ends of the cable can be retrieved in two rather than three grapnel drives. However such grapnels have tended to be complex and unwieldy and consequently are not widely used.

A Remotely Operated Vehicle (ROV) may also be used in place of a grapnel to cut and retrieve the cable ends. Existing grippers deployed by a manipulator arm on such ROVs use a gripper design which holds onto the external sheath of the cable only. These grippers are then intrinsically unable to hold tensions in a sheathed cable above the tension level where as above filleting is initiated.

It is an object of this invention to overcome drawbacks mentioned above.

SUMMARY OF THE INVENTION

According to one aspect of the invention, we propose a cable gripper for gripping cable having an outer protective layer over an inner tensile strength portion, the gripper comprising at least one gripper member, movable between an inoperative position and an operative position, the at least one gripper member having a supported outer end and an active inner end, this end being capable firstly of penetrating the outer protective layer on movement between the inoperative and operative positions, the at least one inner end comprising a material of sufficient hardness to penetrate the outer layer, and secondly of gripping, in the operative position, the inner tensile strength portion beneath the outer protective layer.

Thus, an active penetrative edge is provided which can pass through the outer protective layer until it grips an inner tensile strength portion. The inner tensile strength portion may be elongate. The outer protective layer may surround the inner tensile strength portion.

Thus, the cable can be gripped reliably by penetrating the outer protective layer first. More particularly, the inner strength portion of the cable can be securely gripped with the result that it is possible to avoid losing the end of cable. By providing an active penetrative edge which can go through outer sheath material but not inner tensile strength portion material, the inner end of the gripper stops at the inner tensile strength portion and holds and grip it.

Furthermore, there is no dependence on adhesion or friction between the various layers in the cable, as the gripper is directly gripping the inner tensile strength layer, so there is no risk of filleting. The present invention may then allow much higher levels of tension to be transmitted through the gripper and cable than existing shown devices. The at least one inner end may be capable of penetrating the outer protective layer by plastically deformation. This edge is able to force through the outer protective layer by plastic deformation.

The at least one inner end may comprises a material of sufficient hardness firstly to penetrate outer protective layer material on movement between the inoperative and operative positions and secondly to grip an inner tensile strength portion beneath the protective layer.

The at least one inner end may comprise a material of greater hardness than the outer protective layer for penetrating the protective layer and for gripping an inner tensile strength portion beneath the protective layer.

Typical materials used in the outer protective layer include polyethylene and copper. The inner strength portion of the cable may typically be drawn high tensile steel, and the gripper material may also typically be a high strength steel or a tool steel. The material of the gripper inner ends may be harder than or as hard as the cable inner tensile strength portion; alternatively the material of the gripper inner ends may be softer to enable the gripper end to locally deform to the shape of the inner strength member and consequently to increase grip.

The hardness of a material may be measured by several standards, for instance the Brinell hardness test, and hardness is roughly proportional to tensile strength. The Brinell Hardness numbers may typically be approximately 20 for polyethylene, 80 for copper and 200-1000 for steels. The ultimate tensile strengths of these materials are typically 40 $N/mm^2$ for polyethylene, 220 $N/mm^2$ for copper, and 400-2110 $N/mm^2$ for steels.

In one arrangement the coefficient of friction between the material of the gripper inner ends and the material of the inner tensile strength portion may be as high as practicable since the higher the coefficient of friction, the less grip force is required to hold a given cable tension. The coefficient of friction available between the gripper inner ends and the cable inner tensile strength portion, typically both hard steels, may be around 0.4. This compares favourably to the typical friction coefficient of around 0.1 between steel and polyethylene, as would be achieved where the gripper only contacts the outer sheath of a typical sheathed cable.

The cable gripper may have at least one pair of co-operative gripper members, the inner ends of which are profiled to together define a pre-shaped gripper for secure engagement of cable, providing an inner region to receive and retain the inner tensile strength member. The inner ends may be profiled to enclose the inner tensile strength portion.

The inner ends may be disposed so as to centralise the inner elongate tensile strength portion in the inner region.

The inner ends may have active edges, for example arc-shapes or V-shaped, which together provide an inner region having a transverse cross sectional shape of for example a diamond or an oval.

The gripper members of the at least one pair may be opposed or approximately opposed and these gripper members may be linearly moveable radially inwardly or predominantly radially inwardly.

The at least one pair of gripper members may comprise a pair of co-operative opposed transverse plates or transverse pins. Thus, the grippers may consist of sets of interleaved gripper plates, or sets of opposing gripper pins, or a combination of the two. The ends of the gripper members may be narrowed when viewed from the side in a longitudinal section.

The gripper members may be spaced apart around the circumference of a transverse cross section through the inner region.

The cable gripper may comprise a plurality of pairs of gripper members, the pairs being spaced apart along a longitudinal axis through the inner region.

One embodiment of cable gripper may comprise an outer frame having a pair of spaced, confronting walls, confronting jaws each supported on a different one of the walls, a pair of opposed gripper members each mounted on a different one of the jaws, and a plunger movable to and fro through the frame in the direction of the other jaw, the gripper members extending from the jaws.

Another embodiment of cable gripper may comprise an outer support having a pair of spaced, confronting walls, confronting opposed gripper members each movable to and fro through the walls in the direction of the other from the inoperative to the operative positions.

We also propose according to another aspect of the invention, remote cable recovery apparatus including a cable gripper according to the first aspect of the invention and further including any of the above optional features.

In particular, the Applicants have further appreciated that the cable gripper may be employed to recover undersea cables from the seabed to a cable ship, either when incorporated in a grapnel or within a device deployed from the manipulator arm of a Remotely Operated Vehicle (ROV).

The remote cable recovery apparatus may comprise a grapnel comprising a plate having an upper face and a lower face including a tow connection at its forward end and at least one fluke at its rearward end, the fluke including a space housing the cable gripper, the space having a forward region for retaining the cable gripper while inoperative and a rearward receiving region for receiving the cable gripper once operated, the fluke including a device to actuate the cable gripper.

The plate may include a through-hole providing access from the upper face of the plate and access from the lower face of the plate, whereby cable obtained from either face can be gripped.

The internal side walls between the forward and rearward regions may be tapered so as to inwardly move the gripper members upon the cable gripper being urged rearwards; alternatively a mechanism to inwardly move the gripper members upon the cable gripper being urged rearwards may be provided.

The apparatus may further include a device to automatically capture and sever the captured cable.

The apparatus may further include a pair of grippers, a device to sever the cable between the grippers, and means to divide the apparatus into two or more parts, with a gripper on each part, and each part attached to a recovery line, whereby both ends of the severed cable can be recovered with a single pass.

The apparatus may further include a device to apply a controlled amount of gripping pressure according to the material of the tensile strength member, for example a hydraulic device. In practice this may not be necessary because a typical grapnel tow rope may not break until 30-40 tonnes tension and the apparatus may be able to withstand this tension. The maximum pull available at the cable ship engine may be of the same order. Furthermore, the at least one gripper inner end may be sufficiently blunt to be unable to sever a cable with such tension.

According to another aspect of the invention we propose a cable gripper for cable comprising a tensile strength member, the gripper comprising a series of gripper plates, movable between an open and a closed position, to grip the strength portion directly.

According to another aspect of the invention we propose a method of gripping cable having an outer protective layer around an inner elongate tensile strength portion, the method comprising the steps of capturing a longitudinal portion of cable, moving at least one gripper member inwardly from an inoperative position to penetrate cable from the outside of the cable until the at least one gripper member holds the elongate tensile strength portion beneath the protective layer, and retaining the gripper member in the operative gripping position.

The method may employ a plurality of gripper members having inner gripper ends, and may comprise moving the gripper members relatively towards one another between a non-operative position and an operative position until the inner ends of the gripper members together hold and grip the inner tensile strength portion.

The method may employ gripper members of which the at least one pair are opposed or approximately opposed and these gripper members may be linearly moveable radially inwardly, or predominantly radially inwardly, until the grippers centralise the inner elongate tensile strength portion in the inner region.

The Applicants have found that retaining wholly or predominantly the external shape of the inner strength portion while gripping optimises the grip obtained. By predominantly is meant so that the cross section has a major axis which is no more than twice the minor axis length.

According to another aspect of the invention we propose a method of recovering subsea cable comprising:

moving a remote cable recovery device past a cable to be recovered, locating a required portion of cable with a remote cable recovery device including a cable gripper, capturing and gripping the portion of cable in the same pass of the remote cable recovery device, severing the cable in at least one location, and recovering the at least one severed cable end.

This method allows the cable to be gripped reliably and severed. The severed cable may then be recovered for assessment, repair or replacement.

The apparatus may comprise a pair of cable grippers, a device to sever the cable between the grippers, and means to divide the apparatus into two or more parts, with a gripper on each part, and each part attached to a recovery line, so that both ends of the severed cable can be recovered with a single pass.

According to another aspect of the invention we propose a cable gripper for cable comprising a tensile strength member, the gripper comprising a series of gripper plates, movable between an open and a closed position, to grip the strength portion directly.

Thus, according to this aspect opposing gripper plates cut through the outer sheath of the cable as the gripper is closed. The plates and their actuation assembly are designed such that they can cut through the relatively soft outer sheathing of the cable. Once in contact with the strength portion inside the cable, the grippers grip the strength portion directly rather than cut further.

Since the materials of both the plates and the strength members inside the cable are typically steel, the coefficient of friction available for gripping is much higher than if the grip is via a lower friction material such as polyethylene sheath. Additionally, again there is now no dependence on adhesion between the various layers in the cable, as the gripper is directly gripping the strength portion, so there is no risk of filleting. The present invention may then allow much higher levels of tension to be transmitted through the gripper and cable than existing known arrangements.

The grippers may be shaped such that as they penetrate the outer sheath of the cable, the cable is centralised within the gripper. This ensures that the inner strength portion is fully captured.

To provide this capability, the gripper shape transverse to the cable axis is typically a pair of either opposing concave arcs or 'v' profiles. The gripper shape longitudinal to the cable is of sufficient thickness to withstand the cable tensions it will need to hold, yet thin enough to enable efficient penetration of the outer sheath of the cable. The shape longitudinally may be selected according to the softness of the material to be penetrated and subsequently gripped. Thus, some applications may require a series of such grippers arranged longitudinally on the cable.

The grippers may be shaped such that, as they are forced against the inner strength member, the shape of the inner strength portion is not excessively distorted. The inner strength portion is typically of a multi-wire rope construction, and typically surrounds the cable central core, such as a fibre optic package. During the gripping procedure, the cross sectional shape of the inner strength portion may be distorted from circular to, for instance, oval, or approximately diamond shape, depending on the shape and hardness of the gripper surface used. Alternatively the gripper surface may be distorted during the gripping procedure to match the cross sectional shape of the inner strength portion. However in both cases a key factor is that the inner strength portion is forced into an inner region having an enclosed, restricting cross sectional area, such that it is not able to extrude outside. This ensures that variation in displacement of the wires is minimised, so that as many wires of the rope as possible are involved in the gripping procedure, and each wire takes a similar level of tension, so that the available grip on the entire strength portion is maximised. To provide this, the grippers, transverse to the cable axis, may be, for instance, a pair of either opposing concave arcs or 'v' profiles.

More particularly, the Applicants have found that by providing an inner region which allows the external shape of the inner strength portion to be wholly or predominantly retained (i.e. so that the cross section has a major axis which is no more than twice the minor axis length) the grip obtained is optimised.

Additionally, this arrangement ensures that a relatively low stress concentration is imposed in the transition region between gripped and ungripped sections of the cable, thus maintaining maximum cable strength.

In achieving the grip with this arrangement, the outer sheath of the cable is locally damaged but can be repaired or replaced. This often may not matter: for instance, when a submarine telecommunications cable needs to be recovered to a ship for repair, the damaged section of the cable will be cut out and replaced anyway.

BRIEF DESCRIPTION OF THE DRAWINGS

In order that the invention may be understood more easily, two embodiments according to the invention, by way of example, will now be described referring to the drawings. FIGS. 1 to 5 relate to a gripper device using gripper plates.

FIG. 1 is a front view of a first embodiment of cable gripper with a caught cable in place before operation of the gripper;

FIG. 2 is a front view of the gripper of FIG. 1 after operation;

FIG. 3 is a detailed partial, front view of one pair of gripper plates, showing the plates holding the cable internally;

FIG. 4 is a side view of the gripper and cable after activation;

FIG. 6*a* is a schematic diagram showing a grapnel drive across a line of subsea cable;

FIG. 6*b* is a schematic diagram showing an ROV drive across a line of subsea cable;

FIG. 7 shows schematically a side view of a second embodiment of a cable gripper before operation of the gripper;

FIG. 8 shows a side view of the second embodiment after activation;

FIG. 9 is a schematic side view cross section of a pin employed in the cable gripper of FIG. 7;

FIG. 10 shows a side view of a 'flat fish' grapnel incorporating a cable gripper of FIGS. 7 to 9;

FIG. 11 shows a view from underneath of the flat fish grapnel of FIG. 10, having captured a cable;

FIG. 12 shows a cross sectional view of the grapnel of FIGS. 10 and 11 prior to operation; and FIG. 13 shows a cross sectional view of the grapnel after activation.

BEST MODES OF CARRYING OUT THE INVENTION

Figure 4:
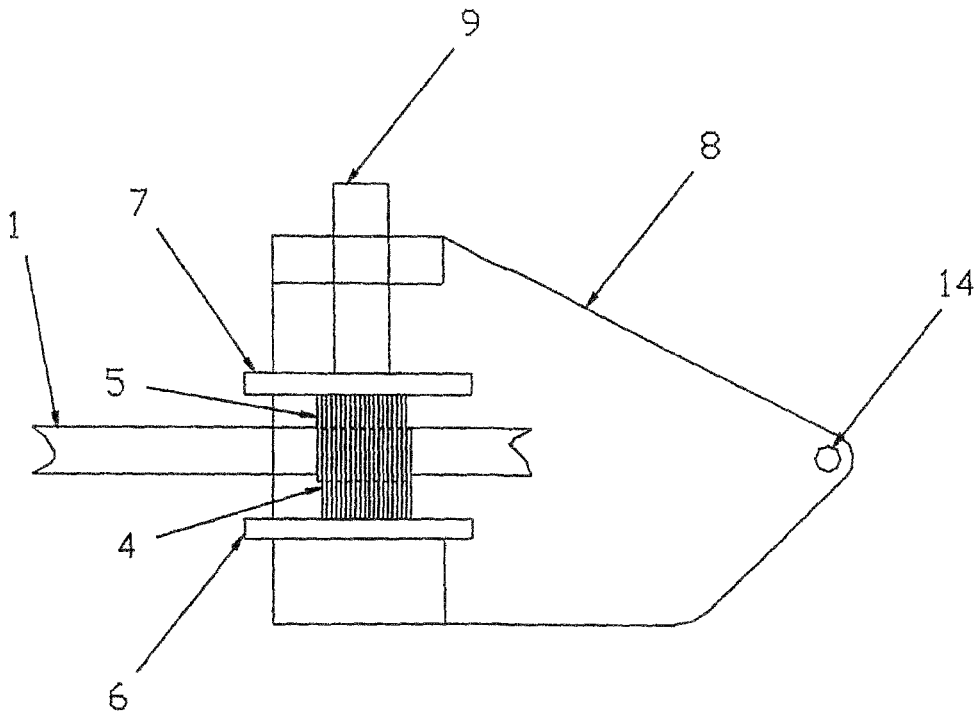

Referring initially to FIG. 1, there is shown a lightweight cable (1) comprising an outer sheath (2) and an inner strength portion (3) concentric with the sheath (described in detail below). A steel cable gripper (100) has a support frame (8), having spaced opposing first and second walls, joined by a third wall to provide an opening opposite the third wall. The support frame provides a space within and between the walls housing a pair of opposed, cable gripping jaws (15,15*a*). The jaws each have a planar support member (6,7). The lower first jaw (15*a*) is seated on the first wall and the upper second jaw (15*b*) is movable to and fro, with respect to the first jaw, guided in an aperture through the second wall. The second jaw is movable by a plunger (9) which is either hydraulically controlled by a person operating the cable gripper remotely, or mechanically actuated locally. The clamp frame (8) includes a towing point (14) for attaching a line to pull, lift or lower the cable.

The jaws are shaped to provide when closed a space there between for surrounding an elongate tensile strength portion within an approximately 5 cm longitudinal portion of the cable. After the plunger acts to move the second jaw towards the first jaw, thereby closing the jaws, a space is left between the jaws for the cable sufficient to allow the inner strength portion to be gripped in a centralised position, with its external shape retained (or nearly retained) as shown in FIGS. 1 to 3 and further described below.

In the first embodiment, as best shown in FIG. 4, a plurality of adjacent pairs of plates are mounted on the jaws. In other words, depending from the planar support member of each jaw is a series of regularly longitudinally-spaced plates, the plates on the first jaw being located further along the jaw so that in the closed position of the jaws, the plates interleave. The plates each have gripping edges, which are also able to cut through the outer polyethylene sheath of the cable.

Each single adjacent pair of upper and lower plates (5, 4) is shaped so as to together provide a space enclosing the inner strength portion of the cable (the individual plates acting in different transverse planes). The plates could alternatively be provided so as to act in the same transverse plane. With a plurality of adjacent pairs as shown in FIG. 4, the security of the gripping function is increased. Thus, with several adjacent pairs of plates the gripping is highly secure.

Referring now to FIG. 2, the upper plates have been pushed down by the plunger (9) against the cable (1), such that the gripper edges of the gripper plates (4,5) have cut through the cable sheath (2) and are forced against the cable strength portion (3). This is shown in more detail in FIG. 3. Thus, in this embodiment the gripping edges of the plates (4,5) form in cross section a 'V' shape profile so that in the operative position of the plates they form the enclosed, central, inner protective space to locate and retain the cable. The 'V' profiles of the plates, cause the cable to be centralised within the plates, and the edges of the profiles form contact points against the strength portion at (10,11) for the upper plates (5) and contact points (12,13) for the lower plates (4).

Alternatively, the edges may be curved or other such shape to fit round the exterior shape of the inner strength portion of the cable and engage the outside of the inner strength member.

The plunger (9) may be activated by, for instance, a hydraulic cylinder (not shown) or a mechanical linkage (not shown). The force required to displace the plunger during the penetration of the outer sheath by the gripper surfaces is relatively low. Once the strength portion is contacted, the resistance force available increases, and consequently the level of cable tension that the gripper can hold increases proportionately to the force applied by the plunger. In order to prevent damage to components of the apparatus, or the gripper surfaces inadvertently cutting through the whole cable, the maximum potential force on the plunger can be limited. In the case of hydraulic cylinder actuation this limitation may be achieved by a pressure relief valve. In the case of a mechanical linkage it may, for instance, be achieved by designing the components around the maximum input force available.

Referring now to FIG. 4, the interleaving of the plate sets (4,5) is seen. Ten upper and ten lower plates are shown, but the actual number of plates used may be increased or reduced, even down to a single pair of plates, to suit the application.

The above gripper may be employed alone or may be incorporated into another device. An example is given in FIG. 5, which shows an embodiment of the gripper incorporated in a grapnel for recovery of lightweight submarine telecommunications cable from the seabed.

One example of cable which can be gripped with the cable grippers described in the two embodiments is a deep-sea non-armoured lightweight cable such as supplied by, for example, Alcatel, Tyco, OCC, NSW, Ericsson, and Fujitsu. In cable supplied by Alcatel the inner strength portion consists of a steel tube protected by two layers of steel wires which form a high tensile strength vault. The steel tube contains an innermost central fibre unit structure, having up to 12 pairs of optical transmission fibres lying freely in a jelly. The vault is itself surrounded by a hermetically sealed copper tube. The outer sheath (2) consists of an outermost layer of polyethylene, which provides abrasion resistance and high voltage insulation. The cable may be used at any sea depth down to 8000 meters. The cable is 17 mm in diameter and has an ultimate tensile strength of 70 kN.

The grapnel of FIGS. 5*a* and 5*b* and its method of use will now be described, with reference also to FIG. 6. Referring to FIG. 6, there is shown a cable ship (110) towing a grapnel (130) via a towrope (120). There is also a buoyant or buoyed recovery line (140) attached to the grapnel. The direction of drive for capture and grip of a portion of cable is across a line of undersea cable (150). The corresponding use of an ROV (remotely operated vehicle) (500) is illustrated in FIG. 6*b*, the ROV passing over the line of undersea cable (150). It will be appreciated that a gripper, similar to either of the above embodiments, may be used on a manipulator arm (501) of an ROv as an alternative method of recovery to using a grapnel.

Figure 5A:
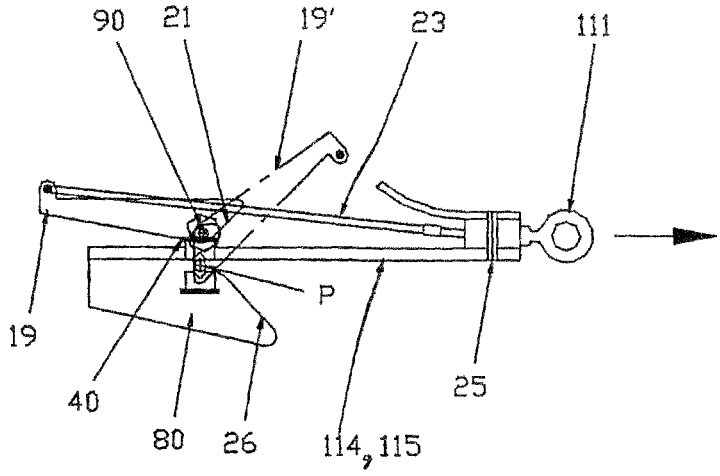
FIG. 5*a* is a side view of a subsea grapnel for recovery of cable fitted with the first embodiment of the cable gripper.
Figure 5B:
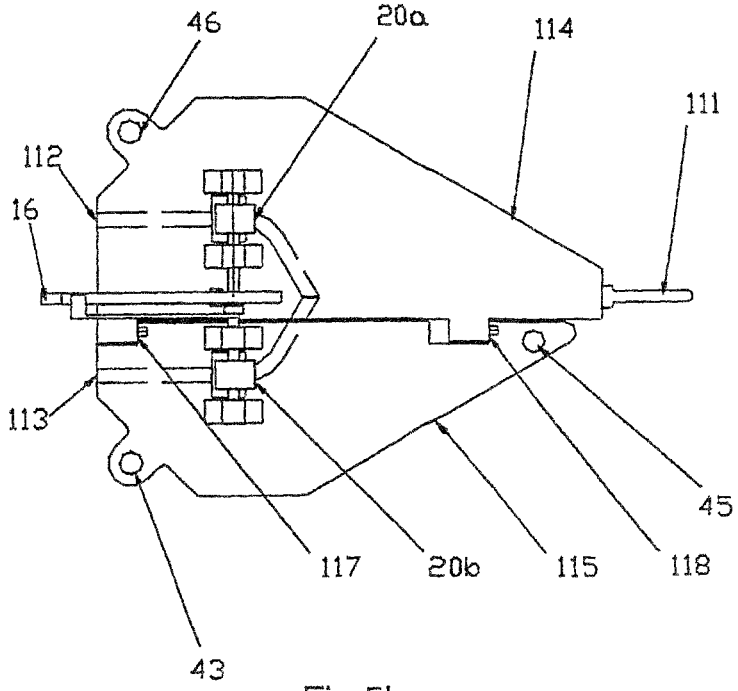
FIG. 5*b* is a plan view of the grapnel of FIG. 5*a;*

Referring now to FIGS. 5*a* and 5*b*, the main features of the grapnel will be described. The towrope is attached at a tow eye (111). The recovery line (140) is attached to an eye (43), or alternatively it may be attached between eye (46) and another eye (43,45). The tine 80 is in two halves, (112,113). This tine is of open 'V' configuration to enable any seabed sediment and other debris to pass through. The purpose of the tine is to engage the cable and lift it into the grapnel. A first half tine (112) is rigidly mounted to the main grapnel base plate (114), and a second half tine (113) is rigidly mounted to a subsidiary grapnel base plate (115).

The tow grapnel base plates (114,115) are initially connected to each other at three triangulated points, to provide rigidity. Two of these points are shown (117,118), and a third point above is not shown. Each grapnel base plate includes a gripper assembly (20*a*,20*b*). The main grapnel base plate (114) includes a tow eye (111) and a main actuator lever (19). A cutter blade (21) is attached to, or is part of, the main actuator lever.

In use the grapnel (130) is towed along the seabed via the tow point (111) until the cable (150) is engaged. Once the tine has located the cable, the forward movement of the grapnel causes the cable (150) to be lifted up the leading edges of the tine (26) and into the position P shown in FIG. 5*a*. The cable is prevented from moving further aft on the grapnel by stops and a plate (not shown).

At this point the tension in the cable and consequently the tension in the towrope will start to rise and this may be used for triggering grip and cut steps, as described below.

Figure 6A:
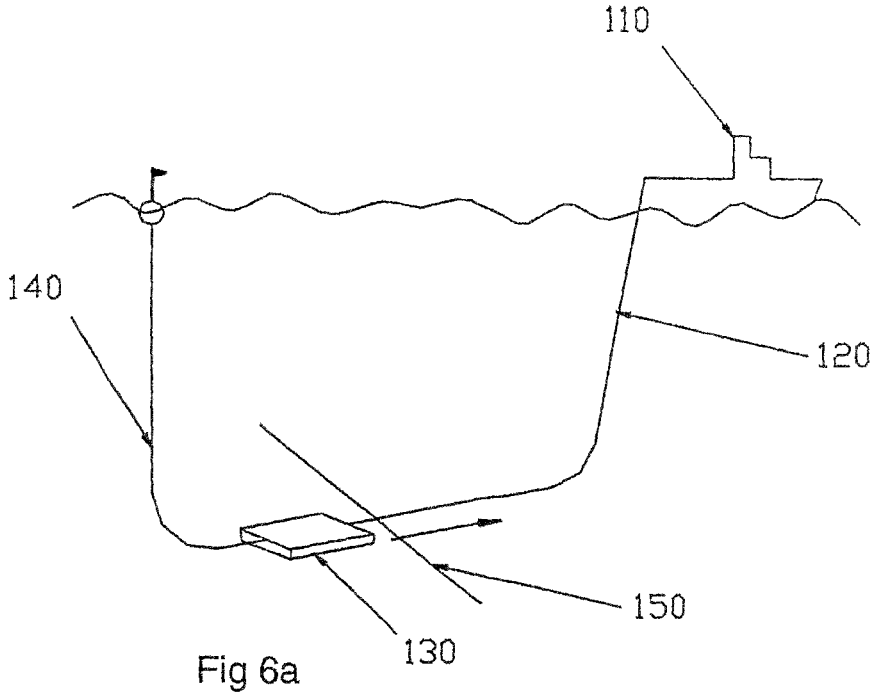
FIGS. 7 to 13 show an alternative gripper device using gripper pins and FIGS. 6*a* and 6*b* show respectively schematics of a grapnel remotely controlled by a cable ship and by a ROV engaged in the recovery of subsea cable, which may utilise either gripper device.
Figure 6B:
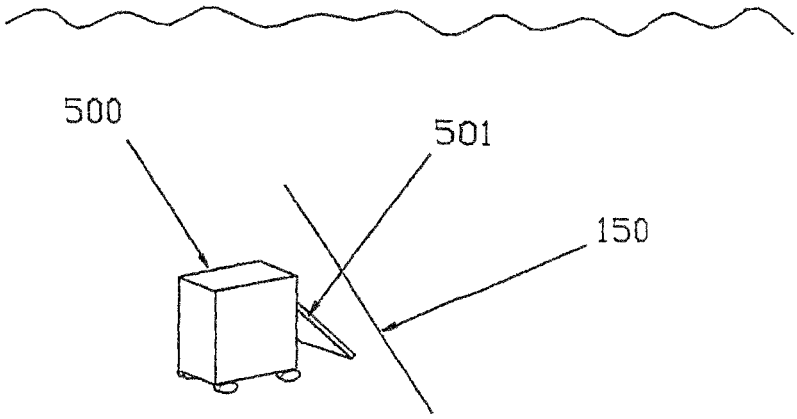

Referring now to FIG. 6*a*, the grapnel (130) has captured the undersea cable (150). The capture has been detected on the cable ship (110) by monitoring the increase in tension in the towrope at the ship as the cable is moved. The ship now stops the forward towing movement and starts to pick up the towrope, as it moves astern. The tension in the towrope at the grapnel increases as the tension in the undersea cable increases as it is lifted from the seabed. The tension developed in the undersea cable as it is lifted is a function of its weight in water, the slack that was installed in the cable, and the friction between the cable and the seabed.

As the grapnel moves forwards and/or upwards, the cable tension rises. This rise in cable tension then triggers the release of the actuator arm (19) (for instance by breaking a shear bolt (25)). A cam surface (90) fixed to the actuator arm (19) then acts against the upper plate carriage (40) and the cable is gripped, as the actuator arm swings to its second stable position (19'). The arrows (19') indicate the direction of force applied to the cable gripper due to this m movement of the actuator arm. The cutting edge (21) may be fitted to one side of the actuator arm between the two gripper stations.

An additional mechanism (not shown) may next be activated to divide the grapnel into two parts. The subsidiary grapnel base plate (115) is pushed forward relative to main grapnel base plate (114), releasing the connection points between the two base plates at (117, 118).

Subsidiary grapnel base plate (115), with one end of the cable retained in one gripper (20*b*), will then separate from the main grapnel base plate 114, and can subsequently be recovered to the cable ship using a line (140). The main grapnel base plate (114), with one end of the cable retained in another gripper (20*a*), can be recovered to the cable ship (110) by winding in tow rope (120). The internal strength portion is retained in the enclosed space defined between the inner ends of the grippers as described above. Thus, the grapnel can recover both ends of the lightweight cable in a single drive or pass.

The tension in the towrope at the ship is monitored during grapnel operations, and is generally used as the main indicator as to when the cable is captured or cut, so that the ship can be stopped and the recovery sequence started. However where this towrope tension is dominated by the towrope weight and drag, and the tension attributable to forces on the grapnel such as cable tension are comparatively small, as may be the case for lightweight cable in deep water, there may be no clear signal at the ship that the recovery operation may commence. This is avoided by the grip, cut and divide functions being triggered by the increase in cable tension at the grapnel, rather than at the ship, so that ship operations do not need to be so precisely controlled. Alternatively the grapnel may have instrumentation and be able to transmit control signals to the ship to indicate cable and towrope status at the grapnel.

Figure 7:
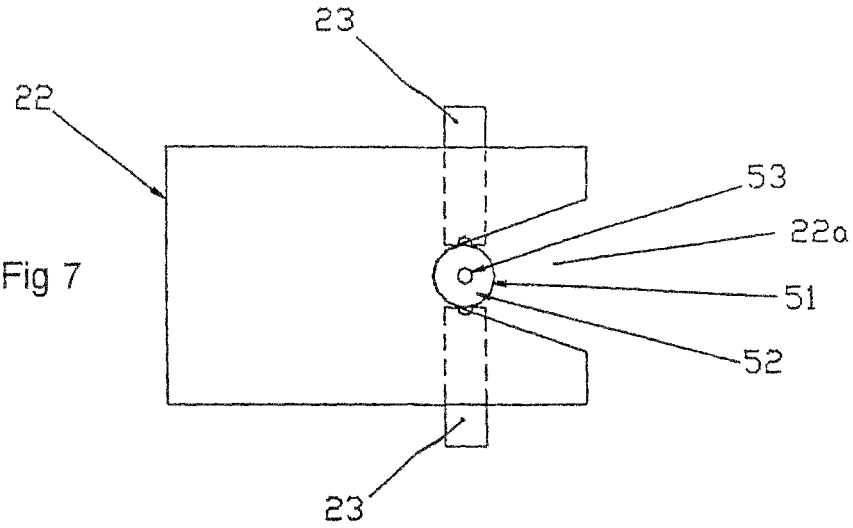
Figure 8:
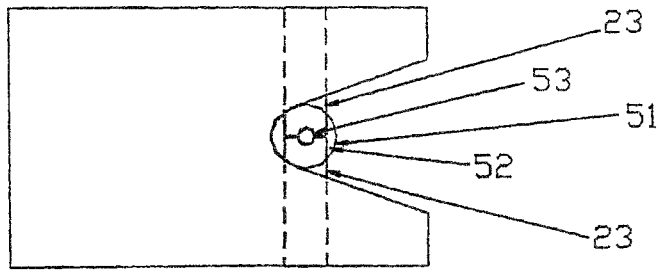
Figure 9:
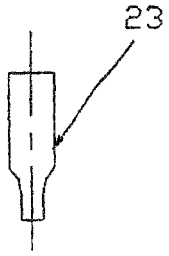

FIGS. 7, 8 and 9 show an alternative gripper embodiment, which may be used for the cable described above or similar applications to other above mentioned applications of the plate gripper embodiment.

Referring initially to FIG. 7, there is shown a cable 51 comprising an outer sheath (52) and an inner strength portion (53). A longitudinal portion of the cable (51) is held within an outer support block (22). The block may have an open side (22*a*) as shown in the figure to enable side entry of the cable. If the gripper is designed to attach to a cable end and not a longitudinal portion of cable, the block may be disposed wholly circumferentially around the cable.

Within the block are mounted opposing gripping pins (23) radially positioned relative to the cable and in the same transverse plane as one another. Only a single pair of opposing gripper pins is shown, but an alternative embodiment could have several opposing radial sets, arranged in the same plane around the full cable circumference to form a circumferential ring of opposing grippers. One or more further sets may be provided, each set longitudinally-spaced from each adjacent set.

The pin end shape, as in the first embodiment, is such that a space is left between the gripping edges of the jaws sufficient to allow the inner strength portion to be gripped in a centralised position, so that the gripping edges fit round the exterior shape of the inner strength portion of the cable and engage the outside of the inner strength member, with its external shape retained (or nearly retained). This is shown in FIG. 8.

As shown in FIG. 9 the inner ends of the gripping pins (23) are narrowed to provide ease of penetration of the cable outer sheath, yet still able to retain adequate strength to transmit axial and radial loads to the cable.

The number of opposing pin sets arranged longitudinally along the cable in the device may vary according to the application, but at a minimum shall comprise a single set.

Referring now to FIG. 8, the pins (23) have been actuated and forced through the outer sheath of the cable, locally displacing the outer sheath material, to make contact and grip onto the cable strength portion (53).

As with the first embodiment this pin gripper device may be employed in a grapnel for recovering submarine cables to a cable ship. A grapnel for use with this pin gripper will now be described, with reference to FIGS. 10 to 13.

Figure 10:
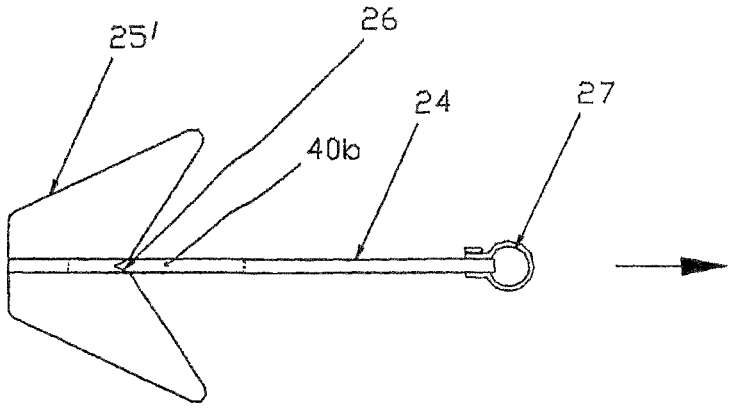
Figure 11:
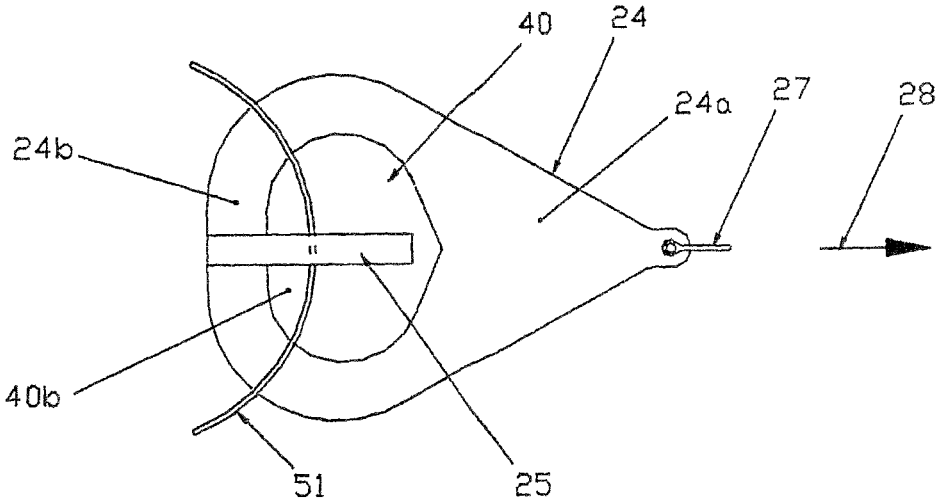

The grapnel consists of a flat base plate (24), having a pointed forward end (24*a*) for ease of passage through water and over the seabed, and a curved rearward end (24*b*). A tow wire (indicated by arrow 28) is attached to the tow ring (27) at the pointed forward end of the grapnel. To each side of the plate the grapnel is joined to a double fluke portion (25') providing opposing flukes or prongs (25), These correspond to the tines in the first embodiment, but in this second embodiment the cable can be caught and engaged whichever way up the grapnel lands on the seabed. This is similar in side view to a standard 'flat fish' grapnel, widely used in the submarine telecommunication industry. The principal difference is that, instead of there being a capture location both sides of the base plate (24), there is a single cable grip region (26) at the centreline of the base plate (24), which has a central through-hole (40) to enable the cable to move down either fluke (25) into the single grip region (26), as shown in FIG. 10, where a cable (51) is shown captured by the grapnel. The double fluke portion (25') is made of steel.

Figure 12:
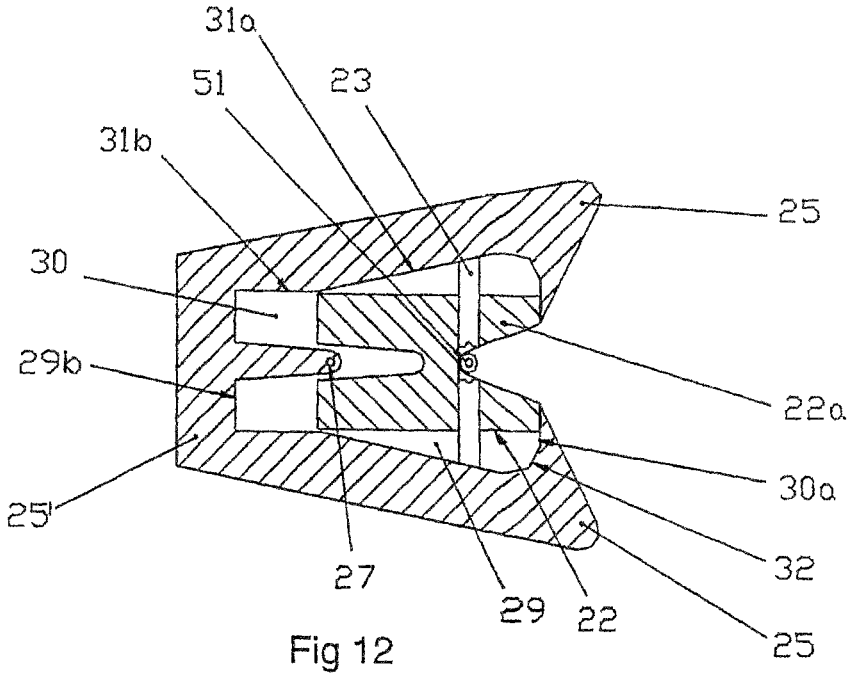

FIG. 12 is a vertical section through the grapnel. The pin gripper described earlier is housed within an undercut recess (29), which is provided between internal walls (31) of the flukes towards the rearward end (40*b*) of the through-hole (40). The undercut recess has a rearward region (30) for receiving the cable gripper in the operative position. The internal walls (31*a*) of the forward end are outwardly sloping and the recess tapers inwards so that the resulting straight internal walls (31*b*) of the rearward end provide a region substantially complementarily-shaped to the support block (22) for receiving the support block as discussed below.

In the non-operative position the support block (22) is connected to the grapnel structure (25) via a shear pin (27) projecting inwardly from the double fluke member. The forward end (22*a*) of the support block engages inner faces of return walls (32) providing the undercut forward end (30*a*) of the recess.

Figure 13:
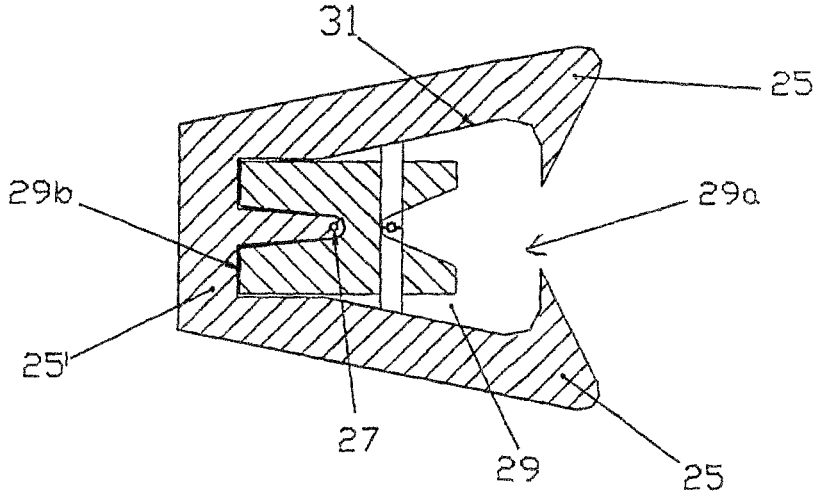

Once the cable (51) is engaged in the grapnel grip region (26) and the grapnel continues to be towed forward, the tension in both cable (51) and tow wire (28) rises, until the shear pin (27) is broken. Under the action of the opposing tow wire tension and the cable tension, the grapnel structure (25) now moves forward relative to the gripper support block (22), and the gripper pins (23) are automatically depressed by the walls (31*a*) of the flukes, until the gripper pins (23) of the pin cable gripper are fully deployed in the operative position as described above and grip the cable inner strength portion as shown in FIG. 13. At the same time the support block is wedged into the rearward receiving region (30) at the rearward end (29*b*) of the recess (29), with the projection from the double fluke portion located in a recess at the rear of the support block. The gripper pins are thereby kept in their operative position and the cable is thereby securely gripped. The internal strength portion is retained in the enclosed space defined between the inner ends of the grippers as described above.

A secondary device may then be deployed (not shown), acting through another shear pin, to cut the cable to one side of the gripper, such that the grapnel can be retrieved to the cable ship holding one end of the cable only.

It will be appreciated that this second grapnel embodiment shown in FIGS. 10 to 13 could further be adapted to provide a split fluke, two grippers, a cutter between the grippers, and a mechanism to divide the grapnel into two portions similar to as shown in the grapnel embodiment of FIG. 5*b*, so that both ends of the cable can be retrieved in a single pass of the grapnel across the cable.

Therefore, with the grapnels as above described, it is now possible to reliably grip subsea cable. Furthermore, a single grapnel may be employed to capture and grip cable in an effective manner. In addition grapnels of the invention benefit from its principal gripping parts being essentially mechanical rather than hydraulic and/or electronic, which helps to improve reliability and minimise maintenance.

Employing grapnels of this invention is likely to save two days of ship operation time owing to the combined capture and grip, resulting in considerable cost saving, and it also reduces the length of cable that will need to be cut out, which would otherwise require spare replacement cable to be added to effect the repair. This saving of cable is approximately equivalent in length to the water depth at the repair site, again saving expense.

It should be noted that plates could be used rather than some or all the pins in this grapnel or other gripper devices with an inner gripper end, or a combination thereof.

Finally, it should be noted that grippers according to the invention may be used to grip other compositions of fibre optic cable than the specific structure above, for instance cables in which the fibre package is a 'slotted core', or where the steel tube is a segmented tube.

The invention claimed is:

1. A remote cable recovery apparatus, comprising:

an assembly of a cable gripper and a cable, the cable having an outer protective layer comprising a plastically deformable material, and an inner tensile strength portion, the outer protective layer being more readily penetratable by an object harder than the outer protective layer, than is the inner tensile strength portion, the gripper comprising opposed gripping members that pass through the outer protective layer and grip by direct contact the inner tensile strength portion beneath the outer protective layer; and a grapnel comprising a plate having an upper face and a lower face, including a tow connection at a forward end and at least one fluke at a rearward end, the fluke including a space housing the cable gripper.

2. The apparatus according to claim 1, wherein the cable gripper comprises at least one pair of co-operative gripper members, the gripper members of each pair being relatively movable towards one another and inner ends of the gripper members being profiled, together providing a pre-shaped inner gripping region, securely engaging and retaining the inner tensile strength portion of the cable.

3. The apparatus according to claim 2, wherein the profiles of the inner ends are such as to enclose the inner tensile strength portion so that the inner tensile strength portion is configured not to be able to extrude outside the inner region.

4. The apparatus according to claim 2, wherein the inner region allows the external shape of the inner strength portion to be wholly or predominantly retained so that a cross section has a major axis which is no more than twice a minor axis length.

5. The apparatus according to claim 1, wherein each gripper inner end and the cable inner tensile strength portion comprise hard steels.

6. The apparatus according to claim 1, wherein the plate includes a through-hole providing access from the upper face of the plate and access from the lower face of the plate, whereby cable adjacent either face can be gripped.

7. The apparatus according to claim 1, further including a device to automatically sever the captured cable.

8. The apparatus according to claim 1, further comprising a pair of cable grippers, a device to sever the cable between the grippers, and means for dividing the apparatus into two or more parts, with a gripper on each part, and each part attached to a recovery line, so that both ends of the severed cable can be recovered with a single pass.

9. A cable gripper configured for gripping a cable having an outer protective layer comprising a plastically deformable material over an inner tensile strength portion, the outer protective layer being more readily penetrable by an object harder than the outer protective layer than is the inner tensile strength portion, the gripper comprising:

opposed first and second gripping members having respective cable-gripping portions configured to pass through the outer protective layer and of said cable and grip by direct contact the inner tensile strength portion beneath the outer protective layer;

a support structure on which the first and second gripping members are supported with their cable-gripping portions facing each other, the support structure being shaped to allow a said cable to be received between the cable-gripping portions, and the support of the gripping members by the support structure being such as to allow for relative movement of the gripping members between a first position, in which the gripping members are separated relative to each other to allow said cable to be received there between, and a second position in which the first and second cable-gripping portions co-operate to grip said cable located there between; and a drive operable to drive the gripping members from their first to their second relative portions;

wherein the cable-gripping portions of the gripping members comprise at least one pair of parallel planar elements which, in the second position of the gripping members, lie mutually parallel and spaced from each other in a direction transverse to a direction of relative movement of the gripping members, and wherein each planar element has a leading edge which has a cut-out shaped to receive a portion of a periphery of said cable in the second position of the gripping members.

10. The cable gripper according to claim 9, wherein said cut-outs are V-shaped.

11. The cable gripper according to claim 9, wherein the support of the gripping members by the support structure is such that the relative movement there between is a linear movement.

12. The cable gripper according to claim 9, wherein the gripping members are supported by the support structure at respective different, spaced locations on the support structure.

13. The cable gripper according to claim 9, wherein one gripping member is fixed relative to the support structure and the other is moveable relative to the support structure.

14. The cable gripper according to claim 9, wherein at least one gripping member is supported by the support structure for sliding movement relative to the support structure.

15. The cable gripper according to claim 9, wherein the drive is actuated by a mechanical linkage.

16. The cable gripper according to claim 9, wherein the drive is actuated by a hydraulic cylinder.

17. The cable gripper according to claim 9, wherein the cable-gripping portions of the gripping members comprise a plurality of adjacent pairs of said planar elements which, in the second position of the gripping means, form an inner protective space for reception of a cable to be gripped.

18. The cable gripper according to claim 9, wherein the drive further comprises means for limiting the force that can be applied to a cable by the gripping members.

19. A cable-gripping grapnel including a cable gripper according to claim 9.

20. The cable-gripping grapnel according to claim 19, including a device for severing a cable gripped by the cable gripper.

21. The cable-gripping grapnel according to claim 19, including a guide surface for guiding a cable into a location between the cable-gripping portions of the first and second gripping members of the cable gripper.

22. The cable-gripping grapnel according to claim 21, wherein the grapnel comprises a planar support member on which the cable gripper is supported, and includes first and second guide surfaces for guiding a cable into said location from respective opposite faces of the planar support member.

23. The cable-gripping grapnel according to claim 19, including stop means positioned for abutment with a cable to be gripped when the cable is located between the cable-gripping portions of the first and second gripping members.

24. A cable-gripping grapnel including first and second cable grippers according to claim 19, with first and second support members on which the respective cable grippers are mounted, and releasable means connecting the support members to each other.

25. The cable-gripping grapnel according to claim 24, wherein the first and second cable grippers are positioned to simultaneously grip adjacent portions of the same cable.

26. The cable-gripping grapnel according to claim 25, including a device for severing the cable, located between the first and second cable grippers.

27. The cable-gripping grapnel according to claim 19, having a tow connection for attachment of the grapnel to a towing line.

28. The cable-gripping grapnel according to claim 27, wherein the drive of the cable gripper is operable by tension in a said towing line to drive the gripping members of the cable gripper from their first position to their second position.

29. The cable-gripping grapnel according to claim 28, wherein the cable gripper drive includes a pivotable arm which is pivotable from a first position, in which the cable-gripping members of the cable gripper are in their first position, and a second position, in which the cable-gripping members of the cable gripper are in their second position.

30. The cable-gripping grapnel according to claim 28, wherein the support structure of the cable-gripper is mounted for sliding movement relative to a portion of the grapnel providing first and second surfaces which are inclined to the direction of the sliding movement, the first inclined surface contacting the first gripping member and the second inclined surface contacting the second gripping member so that the first and second gripping members move from their first to their second position upon said relative sliding movement taking place.

* * * * *

UNITED STATES PATENT AND TRADEMARK OFFICE

CERTIFICATE OF CORRECTION

PATENT NO. : 8,608,144 B2
APPLICATION NO. : 11/995951
DATED : December 17, 2013
INVENTOR(S) : Thomas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1226 days.

Signed and Sealed this
Twenty-second Day of September, 2015

Michelle K. Lee

Michelle K. Lee
*Director of the United States Patent and Trademark Office*